US012458126B2

(12) United States Patent
Ezzina et al.

(10) Patent No.: US 12,458,126 B2
(45) Date of Patent: Nov. 4, 2025

(54) SELF-CLEANING CASE FOR POWDER COSMETIC PRODUCT

(71) Applicant: ALBEA SERVICES, Gennevilliers (FR)

(72) Inventors: Emir Ezzina, Gennevilliers (FR); Mélodie Bazinval, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 427 days.

(21) Appl. No.: 17/872,700

(22) Filed: Jul. 25, 2022

(65) Prior Publication Data

US 2023/0147318 A1 May 11, 2023

(30) Foreign Application Priority Data

Nov. 9, 2021 (FR) ..... 2111871

(51) Int. Cl.
*A45D 33/00* (2006.01)
*A45D 33/02* (2006.01)

(52) U.S. Cl.
CPC ..... *A45D 33/003* (2013.01); *A45D 33/006* (2013.01); *A45D 33/02* (2013.01); *A45D 2200/1009* (2013.01)

(58) Field of Classification Search
CPC .... A45D 33/003; A45D 33/006; A45D 33/02; A45D 33/24; A45D 33/22; A45D 33/18; A45D 33/008; A45D 2200/1009; A45D 33/16; A45D 33/025; A45D 33/04;
(Continued)

(56) References Cited

U.S. PATENT DOCUMENTS 1,156,456 A * 10/1915 Beck ..... A45D 33/006 132/298
1,383,394 A * 7/1921 Fisher ..... A45D 33/006 132/307

(Continued)

FOREIGN PATENT DOCUMENTS

CN 211559073 U * 9/2020
EP 2965652 A1 1/2016

OTHER PUBLICATIONS

"CN211559073U_translated"; Zhong, Hua (Year: 2020).*
French Application No. FR 2111871, "Search Report," May 30, 2022, 6 pages.

*Primary Examiner* — Thomas C Barrett
*Assistant Examiner* — Holly T. To
(74) *Attorney, Agent, or Firm* — Kilpatrick Townsend & Stockton LLP

(57) ABSTRACT

The invention relates to a case for a powder cosmetic product comprising:

- a base comprising a cavity opening out axially through an opening into a bowl;
- a sifter arranged in the opening;
- a closing cover which is intended to be screwed onto the base between a fully unscrewed position and a fully screwed position in which it is axially brought closer to the opening;
- a seal attached to the cover and comprising a membrane that comprises a contact face over the entire surface of the sifter; characterised in that the contact face of the membrane is elastically deformable in flexion so that the contact face conforms to the shape of the sifter when the cover is screwed on, the contact face having relief elements.

15 Claims, 11 Drawing Sheets

(58) Field of Classification Search
CPC .. A45D 33/06; A45D 2200/051; A45C 5/005; A45C 5/03; A45C 11/008; A47L 25/00
USPC ..... 132/307; 220/578
See application file for complete search history.

(56) References Cited

U.S. PATENT DOCUMENTS 1,641,765 A * 9/1927 Krank ..... A45D 33/025 401/130
2,849,170 A * 8/1958 Roos ..... A45D 33/003 229/125.05
3,018,024 A * 1/1962 Foord ..... B65D 47/0842 222/542
3,167,079 A * 1/1965 Weil ..... B08B 3/10 D9/557
4,029,033 A * 6/1977 Kerwin ..... B65D 17/502 222/541.9
4,106,672 A * 8/1978 Tecco ..... B65D 15/08 222/546
4,586,519 A * 5/1986 Seidler ..... A45D 40/22 132/293
4,681,127 A * 7/1987 Gueret ..... A45D 40/22 D28/78
D352,899 S * 11/1994 Molo ..... D7/401.1
5,896,866 A * 4/1999 Quennessen ..... A45D 40/22 206/823
5,908,037 A * 6/1999 Pierson ..... A45C 13/008 132/304
5,975,368 A * 11/1999 Wood ..... B65D 47/185 222/480
6,009,885 A * 1/2000 Nam ..... A45D 33/006 132/305
6,047,710 A * 4/2000 Irving ..... A45C 13/008 132/294
6,149,008 A * 11/2000 Yuhara ..... A45D 33/006 206/823
6,286,731 B1 * 9/2001 Lillelund ..... B65D 47/0895 222/480
7,100,806 B2 * 9/2006 Schuster ..... A47G 19/24 220/254.2
7,353,831 B1 * 4/2008 Forsline ..... A45D 33/00 132/294
7,841,349 B2 * 11/2010 Bennett ..... A45D 33/006 132/307
8,057,118 B2 * 11/2011 Yuhas ..... A45D 34/04 222/153.07
8,245,886 B2 * 8/2012 Deans ..... A45D 33/025 132/301
8,985,407 B2 * 3/2015 Mack ..... A47G 19/24 222/565
9,220,332 B1 * 12/2015 DeVito ..... A45D 33/22
9,398,799 B2 * 7/2016 Chang ..... A45D 33/006
D838,593 S * 1/2019 Groglopo Favetto ..... D9/449
10,569,942 B2 * 2/2020 Ludewig ..... B65D 83/06
10,709,223 B1 * 7/2020 Kim ..... A45D 33/003
2001/0017140 A1 * 8/2001 Petit ..... A45D 33/008 132/301
2002/0056660 A1 * 5/2002 Gueret ..... B65D 81/245 132/286
2003/0154997 A1 * 8/2003 Lin ..... A45D 33/006 132/307
2004/0173645 A1 * 9/2004 Vogel ..... B65D 47/0809 222/556
2005/0011895 A1 * 1/2005 Lin ..... B65D 51/245 220/293
2005/0087475 A1 * 4/2005 Byun ..... A45D 33/025 206/823
2005/0279753 A1 * 12/2005 Timm ..... A45D 40/222 220/523
2006/0096611 A1 * 5/2006 Leppla ..... A45D 33/006 132/294
2006/0198692 A1 * 9/2006 Petit ..... B65D 83/0005 401/265
2006/0237388 A1 * 10/2006 Kick ..... B65D 47/185 220/839
2007/0017542 A1 * 1/2007 Petit ..... A45D 33/36 132/293
2007/0029226 A1 * 2/2007 Yuhara ..... A45D 33/24 206/823
2007/0228079 A1 * 10/2007 Vogel ..... B65D 47/0838 222/548
2008/0230543 A1 * 9/2008 Kick ..... B65D 47/0838 220/254.3
2008/0251096 A1 * 10/2008 Eng ..... A45D 33/025 132/294
2009/0188517 A1 * 7/2009 Thorpe ..... A45D 33/006 132/307
2009/0188518 A1 * 7/2009 Thorpe ..... A45D 33/006 132/307
2009/0205673 A1 * 8/2009 Richardson ..... A45D 33/02 132/307
2009/0308409 A1 * 12/2009 Zhu ..... A45D 33/16 132/298
2012/0103986 A1 * 5/2012 Wang ..... B65D 47/265 220/260
2013/0068801 A1 * 3/2013 Lai ..... A45D 33/16 222/565
2015/0114965 A1 * 4/2015 Tobey ..... B65D 47/043 220/256.1
2016/0015148 A1 * 1/2016 Chang ..... A45D 33/16 220/254.1
2017/0006995 A1 * 1/2017 Lin ..... A45D 33/003
2017/0013935 A1 * 1/2017 Schlatter ..... A45D 40/16
2017/0129658 A1 * 5/2017 Moody ..... B65D 83/06
2017/0129660 A1 * 5/2017 Hsu ..... B65D 51/18
2017/0202335 A1 * 7/2017 Johnson ..... A45D 33/025
2018/0016055 A1 * 1/2018 Tobey ..... B65D 9/02
2018/0184783 A1 * 7/2018 Cheng ..... A45D 33/02
2018/0338889 A1 * 11/2018 Griffiths ..... A45D 33/006
2019/0029400 A1 * 1/2019 Carraro ..... A45D 33/008
2019/0037999 A1 * 2/2019 Mecca ..... B65D 83/06
2019/0281948 A1 * 9/2019 Eng ..... A45D 33/06
2019/0365073 A1 * 12/2019 Uhlen ..... A45D 33/025
2019/0365074 A1 * 12/2019 Kikuchi ..... A45D 33/006
2020/0000200 A1 * 1/2020 Rossini ..... A45D 33/003
2020/0029672 A1 * 1/2020 Wilson ..... A45D 33/16
2020/0275759 A1 * 9/2020 Chevalier ..... A45D 34/00
2020/0337435 A1 * 10/2020 Hori ..... A45D 34/04
2021/0106115 A1 * 4/2021 Seguin ..... A45D 33/16
2021/0114049 A1 * 4/2021 Rousseau ..... B05B 11/1047
2021/0267350 A1 * 9/2021 Carraro ..... A45D 40/0068
2021/0330055 A1 * 10/2021 Lee ..... A45D 42/04
2022/0346524 A1 * 11/2022 Blagg ..... A45D 34/04
2022/0400832 A1 * 12/2022 Hori ..... A45D 33/003
2023/0095112 A1 * 3/2023 Seguin ..... A45D 33/22
2023/0095209 A1 * 3/2023 Seguin ..... A45D 33/24 132/293
2023/0097231 A1 * 3/2023 Seguin ..... A45D 40/22 132/286
2023/0103213 A1 * 3/2023 Pagneux ..... A45D 40/0068 206/581
2023/0147837 A1 * 5/2023 Ezzina ..... A45D 33/003 220/23.87
2023/0354984 A1 * 11/2023 Yang ..... A45D 33/025
2024/0197055 A1 * 6/2024 Ramsamy ..... A45D 40/221
2024/0260733 A1 * 8/2024 Jacob ..... A45D 33/003
2024/0298778 A1 * 9/2024 Dinata ..... A45D 33/006

* cited by examiner

[Fig.1]
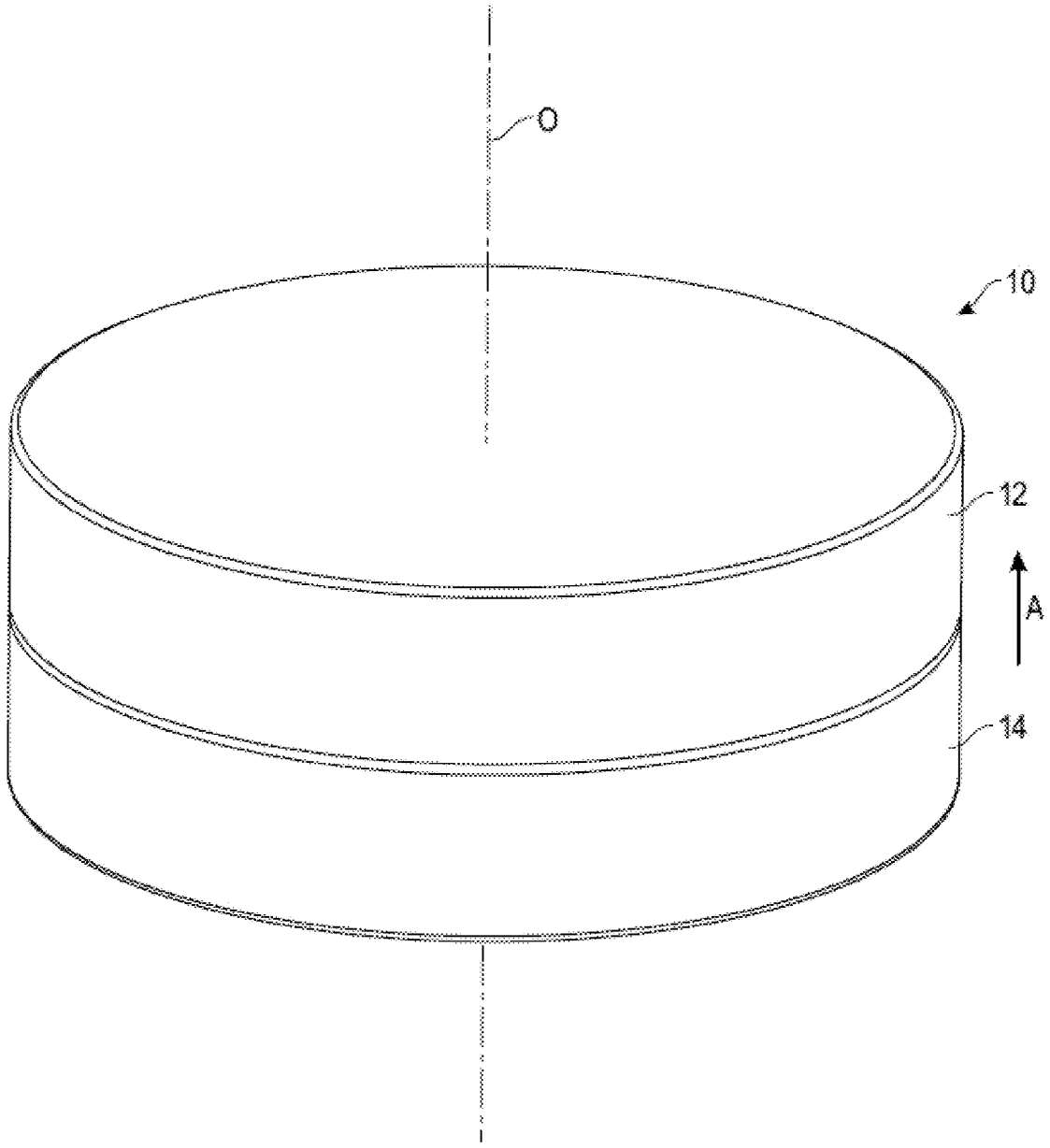

[Fig.2]
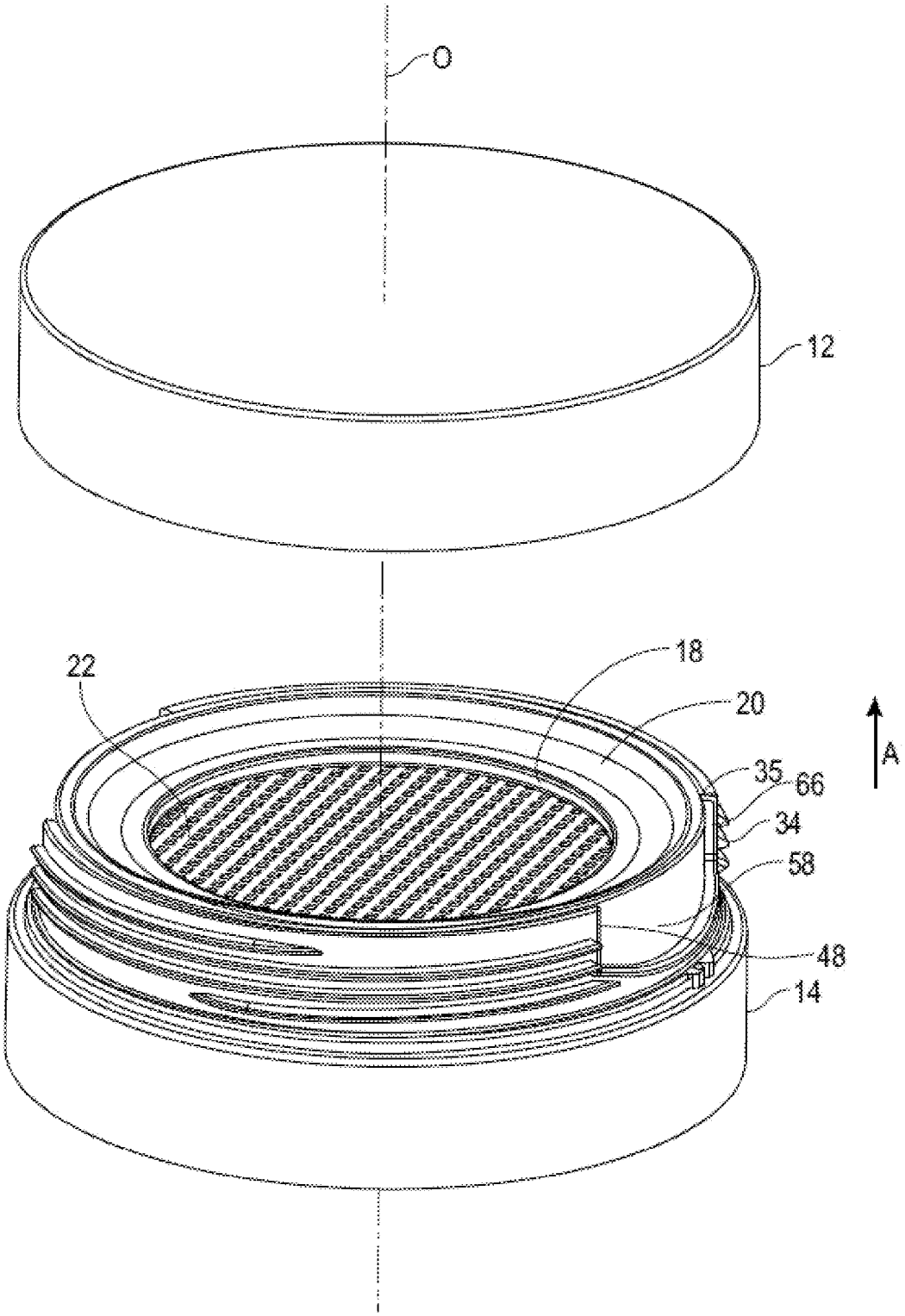

[Fig.3]
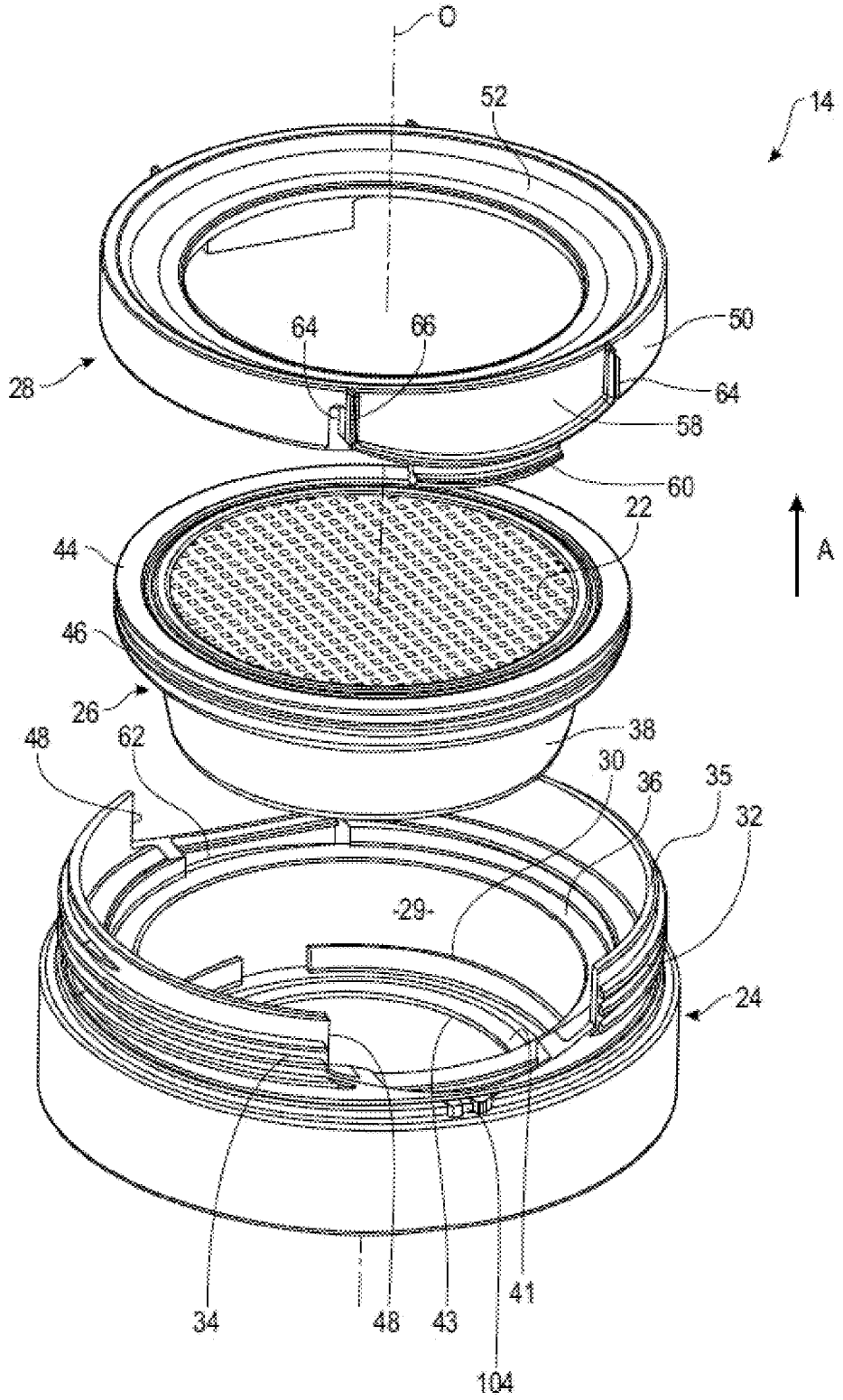

[Fig.4]
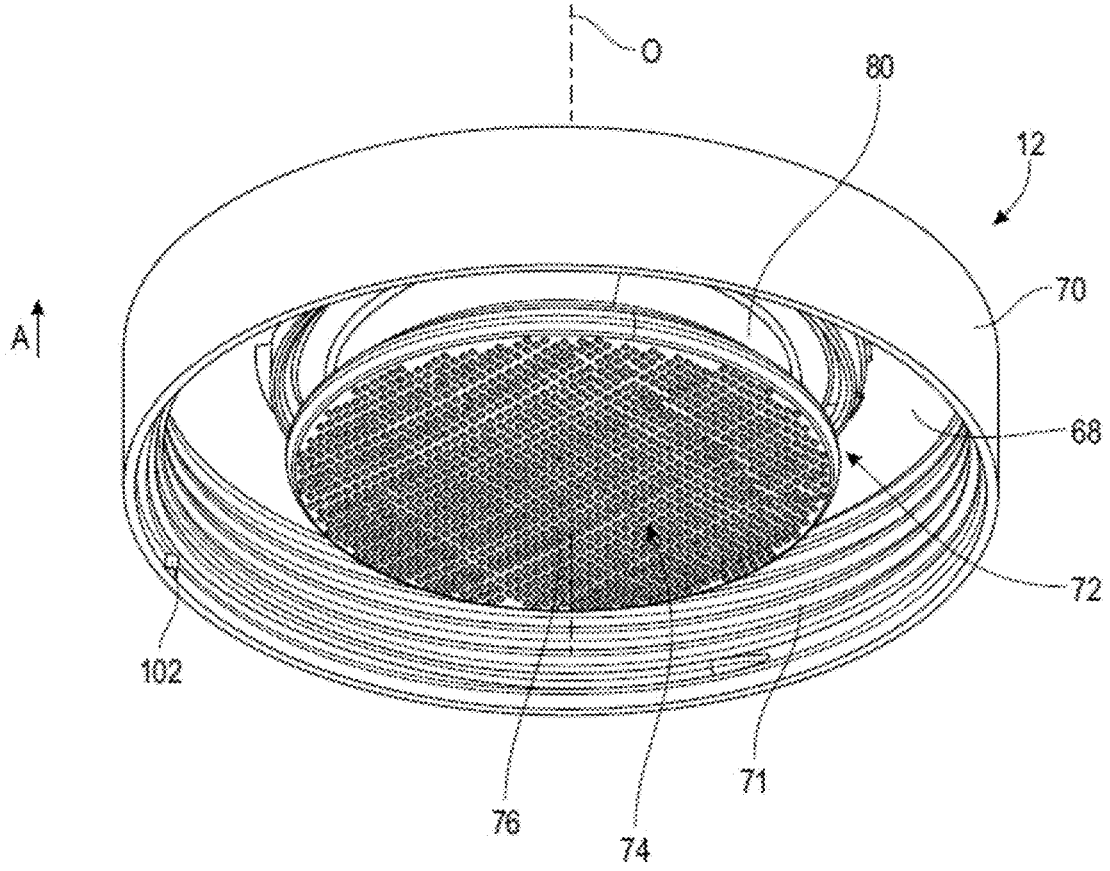

[Fig.5]
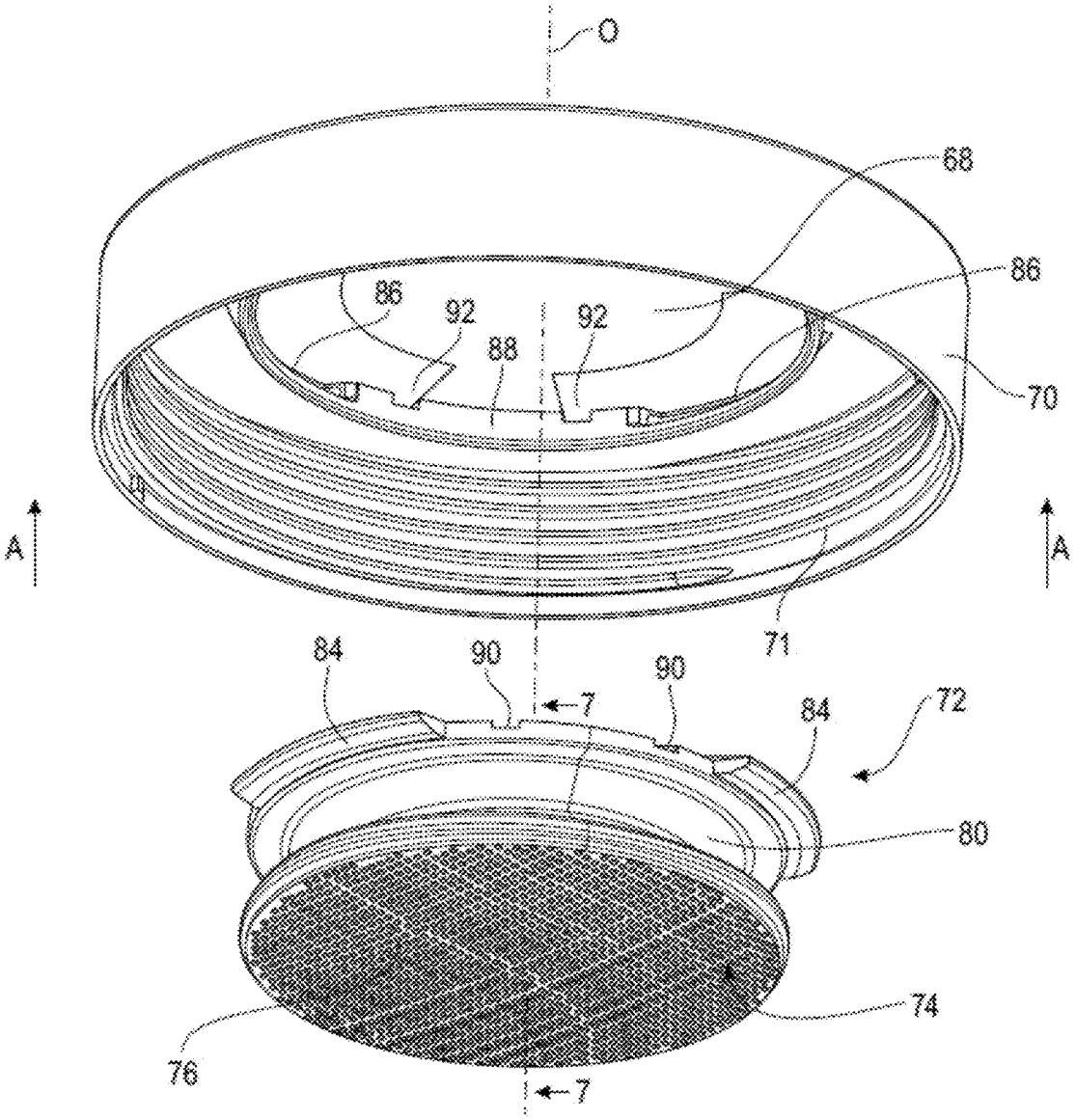

[Fig.6]
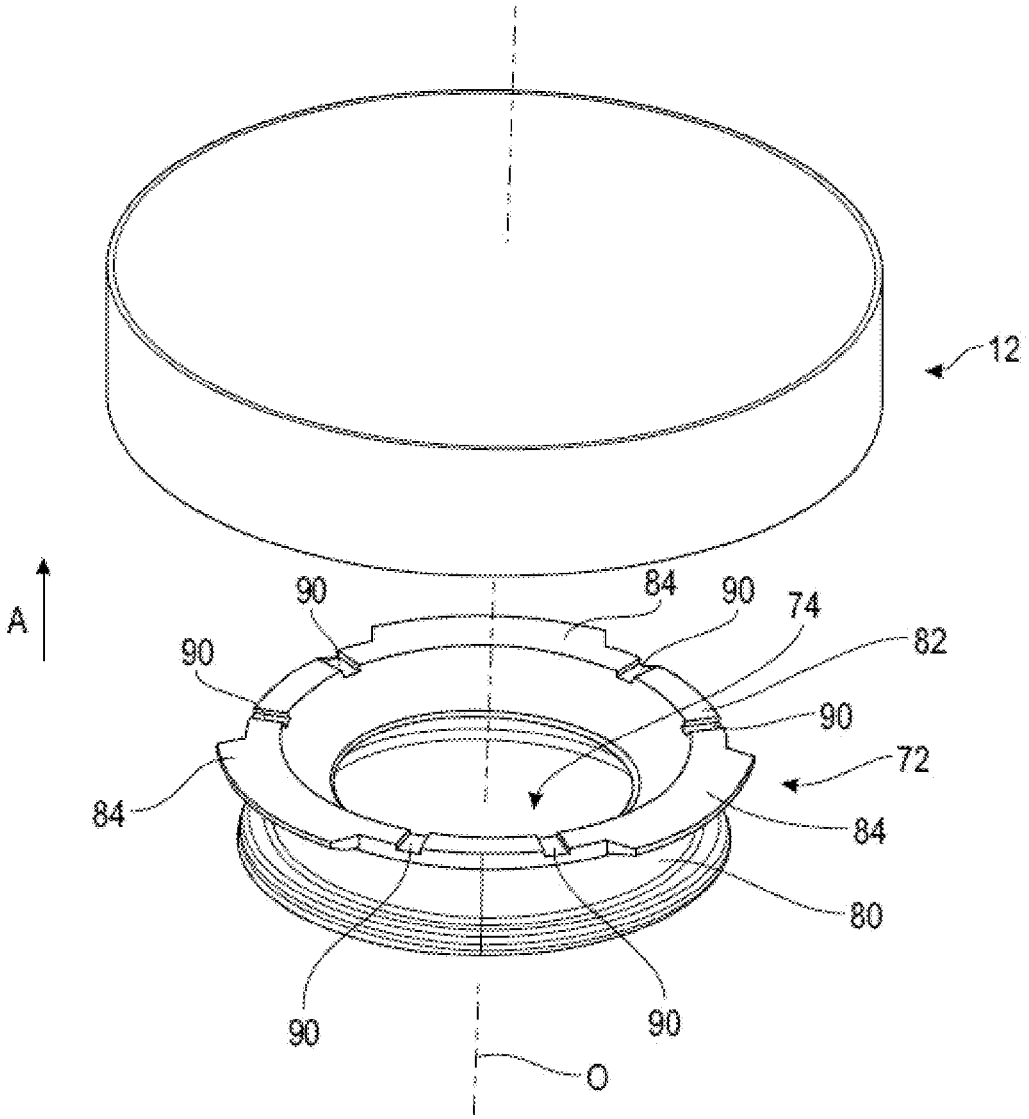

[Fig.7]
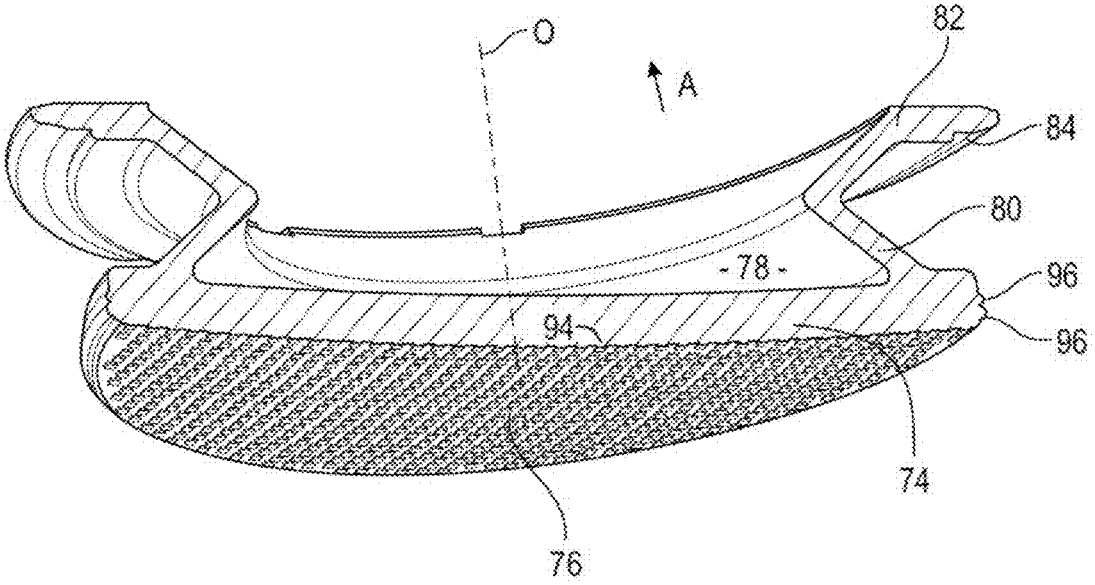

[Fig.8]
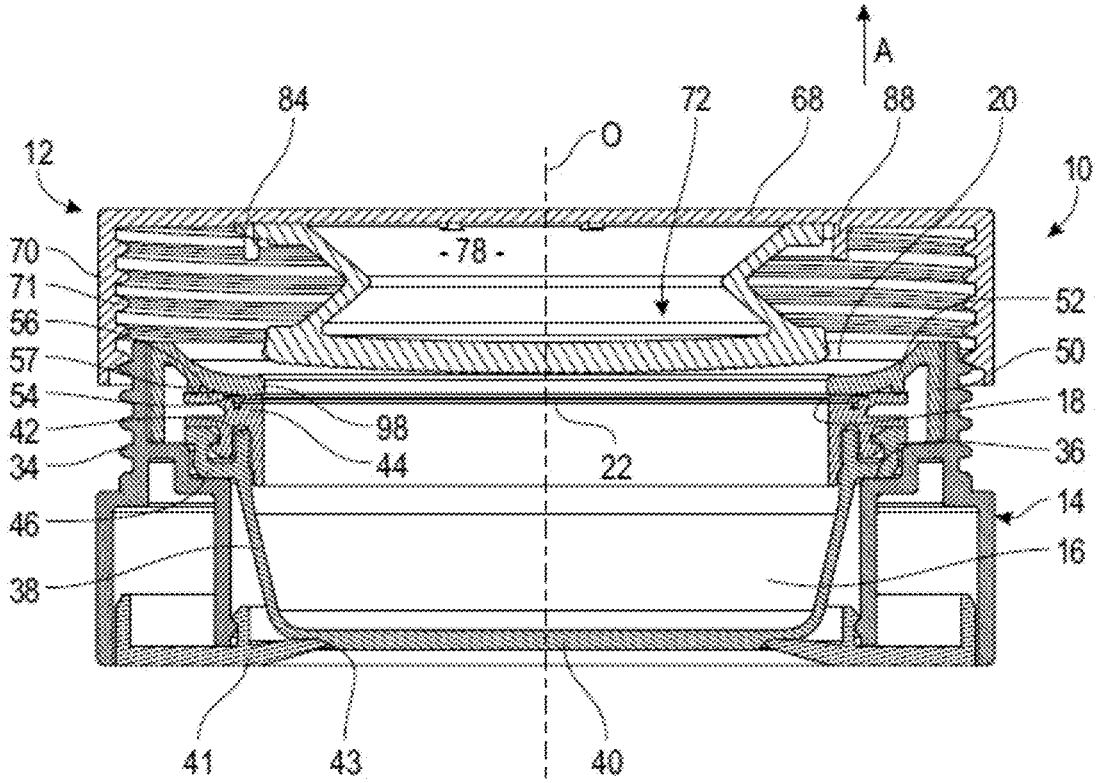

[Fig.9]
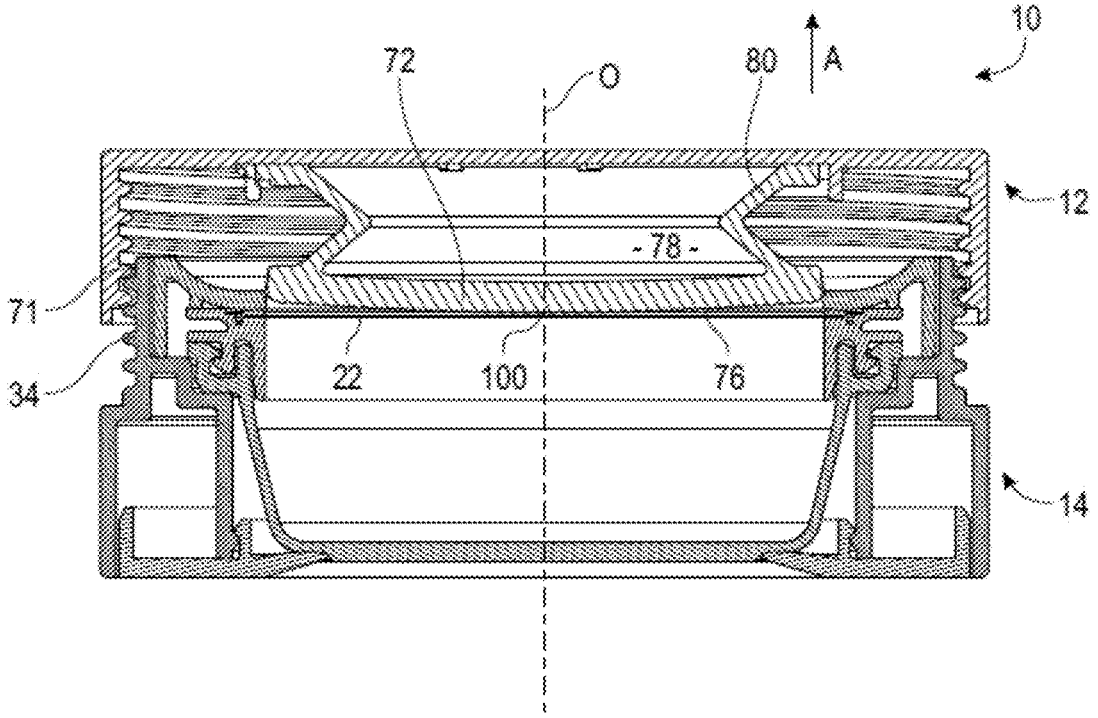

[Fig.10]
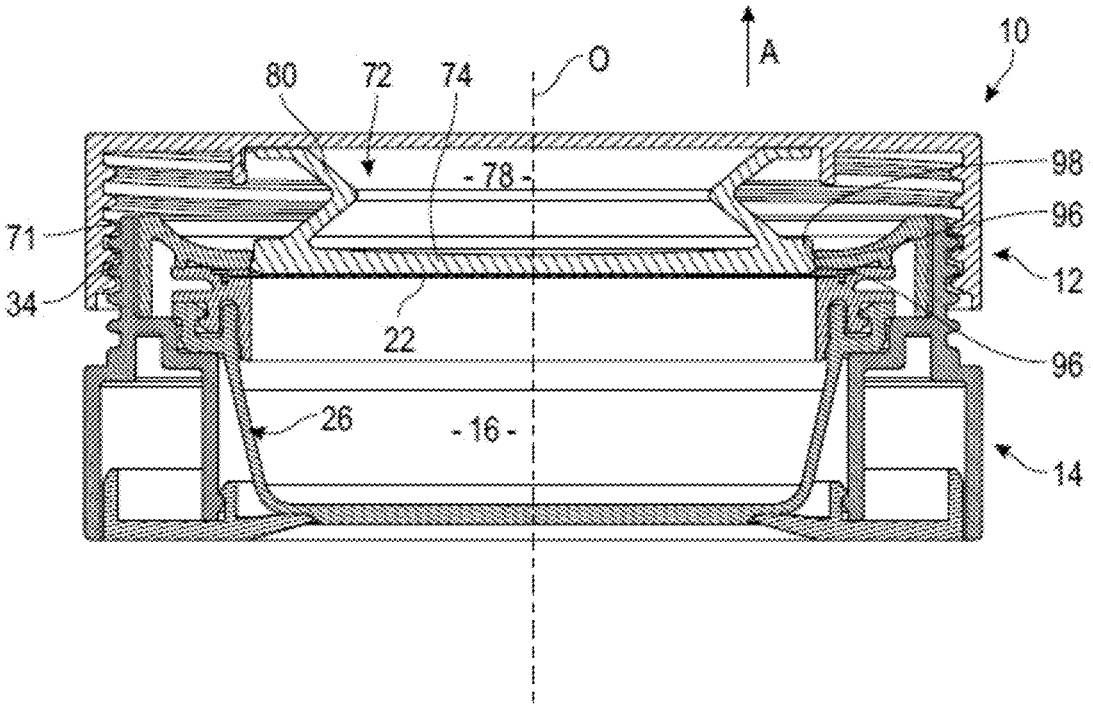

[Fig.11]
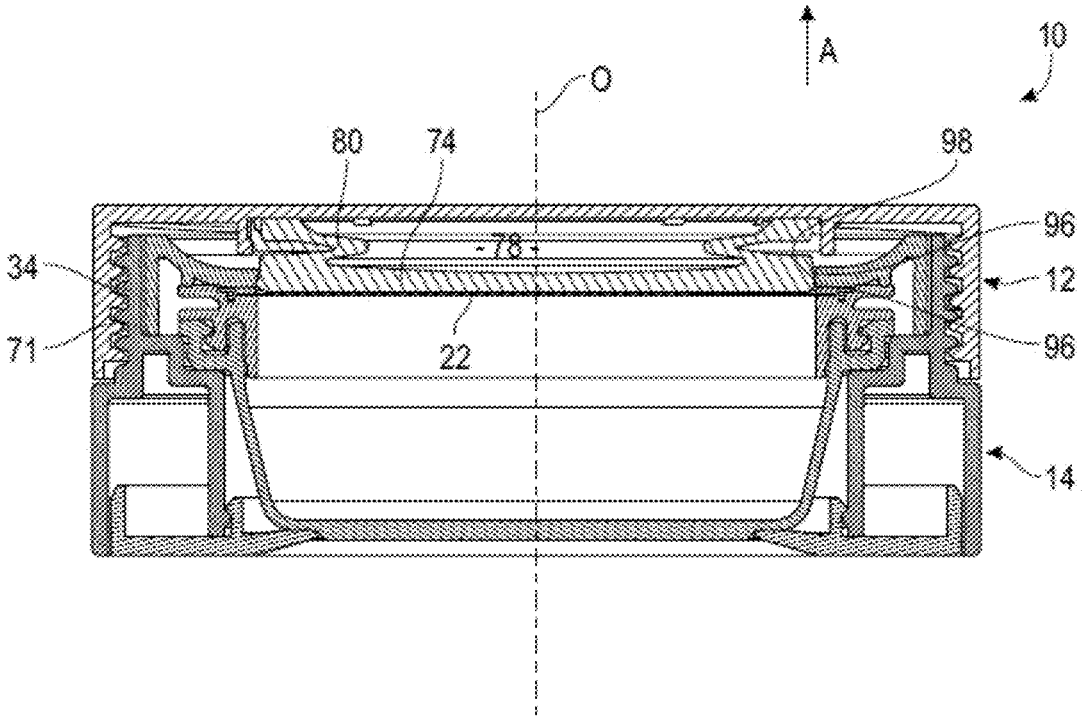

SELF-CLEANING CASE FOR POWDER COSMETIC PRODUCT

CROSS-REFERENCE TO RELATED APPLICATION

This application is related to and claims priority benefits from French Application No. 2111871, filed Nov. 9, 2021 and titled NOM ET ADRESSE DU DEMANDEUR OU DU MANDATAIRE À QUI LA CORRESPONDANCE DOIT ÊTRE ADRESSÉE, the entire content of which is incorporated herein by this reference.

TECHNICAL FIELD OF THE INVENTION

The invention relates to a case for a powder cosmetic product comprising:

- a base comprising a cavity for receiving said product, the cavity opening axially through an opening;
  - a sifter arranged in the opening;
  - a closing cover which is intended to be screwed onto the base between a fully unscrewed position and a fully screwed position in which it is axially brought closer to the opening to allow its sealed closing;
  - a seal attached to the cover by an upper end which comprises:
    - a lateral section elastically deformable in an axial direction;
    - a membrane which is attached to a lower end of the deformable section and which comprises a contact face intended to rest on the entire surface of the sifter;
    - a chamber delimited between the cover and the membrane.

TECHNICAL BACKGROUND

Various examples of case designs are known from the prior art for receiving a powder cosmetic product, such as loose powder or similar products used for make-up.

In a known design, the case comprises a base comprising a cavity for containing a powder cosmetic product, a sifter which is arranged at the level of the opening of the cavity and through orifices of which the cosmetic product is discharged for use.

One disadvantage of such a case is in particular that the powder cosmetic product is dispersed through the multiple orifices of the sifter, in other words uncontrolled discharge of said product from the cavity forming reservoir.

The dispersion of the cosmetic product through the sifter is likely to occur on the one hand during the transport of the case in the closed position and on the other hand during the use of the case in open position. During the transport, the dispersion of the cosmetic product is limited by a cover that covers the sifter in closed position.

To limit such a dispersion during the transport, it is in particular known to place an applicator—typically a sponge—above the sifter so that at least one portion of the cosmetic product dispersed through the orifices is captured by the sponge.

However, the sponge does not completely prevent the dispersion of the powder cosmetic product out of the cavity, which poses a problem for the cleanliness of the case.

In order to achieve a sealed closure of the case, the sponge is therefore pressed tightly against the walls of the case. However, when the sponge is removed, the powder cosmetic product is sucked through the sifter by the suction-cup effect. Thus, it is impossible to open the case without spilling the powder cosmetic product outside its cavity.

In addition, the sponge often comprises an excessive amount of cosmetic product on its face in contact with the grid, making it difficult to use the saturated sponge for make-up.

In an attempt to overcome the problem of dispersion during the transport, it is also known to use a plug, for example secured to the cover of the case. Such a plug is configured to cover the sifter in the closed position of the case so as to isolate it and thus prevent the powder cosmetic product from being dispersed.

However, after using the case, the sifter is covered with powder cosmetic product. However, such a plug does not allow the sifter to be cleaned by reintroducing the powder cosmetic product into the cavity.

As a result, the powder cosmetic product is found in the space between the sifter and the plug, said cosmetic product covers the surface of the plug, in the same way that the face of a sponge in the previous example. However, the cosmetic product on the surface of the plug is then likely to disperse everywhere after the opening of the cover, in particular to come to dirty the case, the hands of the user, etc.

One of the consequences of this dispersion of the powder cosmetic product in use, as well as during the transport, is finally the lack of cleanliness of the case. However, such a defect of cleanliness of the case is particularly badly perceived on the qualitative level, i.e. disappointing for a user.

It is understandable that the handling of a case soiled with powder cosmetic product thus dispersed risks dirtying the hands or even the inside of a bag in which such a case would be conveyed.

To solve this problem, it has already been proposed to use a rigid plug attached to the cover and equipped with fins that scrape the sifter when the cover is screwed. The sifter used is a rigid sifter.

However, such a rigid plug does not allow for satisfactory cleaning of the sifter because once the fins are in close contact with the sifter, they form a stop which prevents the cover from being tightened further.

In addition, such an arrangement requires very precise dimensioning and positioning of the parts in relation to each other to allow the cover to be attached correctly while benefiting from the scraping effect of the fins.

Such a solution is therefore complex and expensive to implement.

SUMMARY OF THE INVENTION

The invention proposes a case for powder cosmetic product comprising:

- a base comprising a cavity for receiving said product, the cavity opening out axially through an opening;
- a sifter arranged in the opening;
- a closing cover which is intended to be screwed onto the base between a fully unscrewed position and a fully screwed position in which it is axially brought closer to the opening to allow its sealed closure;
- a seal attached to the cover by an upper end which comprises:
  - a lateral section elastically deformable in an axial direction;
  - a membrane which is attached to a lower end of the deformable section and which comprises a contact face intended to rest on the entire surface of the sifter;

a chamber delimited between the cover and the membrane.

According to the teachings of the invention, the case is characterised in that the contact face of the membrane is elastically deformable in flexion so that the contact face conforms to the shape of the sifter when the cover is screwed on, the contact face having relief elements.

According to another aspect of the invention, the contact face has a different shape between the fully unscrewed position of the cover and the fully screwed position of the cover.

According to another aspect of the invention, the membrane is elastically deformable in flexion when the cover is screwed on between a state of partial contact of the contact face with the sifter when the cover occupies a first position and a state of total axial abutment of the contact face against the entire surface of the sifter when the cover occupies a second position.

According to another aspect of the invention, during screwing on, the contact face reaches its state of total axial abutment before the cover reaches its fully screwed position, the deformation of the deformable section allowing an axial sliding of the cover towards the sifter up to its fully screwed position.

According to another aspect of the invention, an annular sealing segment of the membrane, which surrounds the contact face, is intended to come into sealed contact with an annular face of the bowl in the fully screwed position.

According to another aspect of the invention, the seal is configured so that, upon unscrewing, a periphery of the contact face begins to move axially away from the sifter to release a peripheral area of the sifter, with a complementary inner area of said peripheral area remaining entirely in contact with the contact face.

According to another aspect of the invention, the seal is configured so that the sealing segment is moved away from its bearing face prior to or simultaneously with the initiation of moving away from the periphery of the contact face of the peripheral area of the sifter to create an interstice for the passage of the air into the cavity through said peripheral area.

According to another aspect of the invention, the contact face of the seal has, in a resting state of the membrane, a periphery of convex shape.

According to another aspect of the invention, in a resting state of the membrane, the contact face has a convex shape over its entire surface from a central point arranged substantially at the level of a central axis of the sifter.

According to another aspect of the invention, the elastically deformable section is formed by an annular bellow that surrounds the chamber.

According to another aspect of the invention, the deformable section has a lower flexibility than that of the membrane so that the contact face begins to deform in flexion before the attachment section.

According to another aspect of the invention, the seal is made in one part.

According to another aspect of the invention, the seal and the cover are made of the same material.

According to another aspect of the invention, the relief elements are evenly distributed over the entire surface of the contact face.

According to another aspect of the invention, the relief elements are pimples.

BRIEF DESCRIPTION OF THE FIGURES

Further characteristics and advantages of the invention will become apparent from the following detailed description, for the understanding of which reference is made to the attached drawings briefly described below.

FIG. 1 is a perspective view of a case produced according to the teachings of the invention, the case occupying a closed position.

FIG. 2 is a perspective view of the case in FIG. 1, the case occupying an open position.

FIG. 3 is an exploded perspective view showing the various components of a base of the case in FIG. 1.

FIG. 4 is a perspective view showing the cover of the case in FIG. 1.

FIG. 5 is an exploded view of the cover in FIG. 4 and a seal equipping it.

FIG. 6 is a similar view to FIG. 5, which shows the cover and the seal from a different angle.

FIG. 7 is a cross-sectional view along the cutting plane 7-7 of FIG. 5 that shows the seal of the cover on a larger scale.

FIG. 8 is an axial cross-sectional view showing the case of FIG. 1 when the cover occupies a fully unscrewed position in which it is laid on its base.

FIG. 9 is a similar view to FIG. 8 in which the cover occupies a first position in which it is partially screwed.

FIG. 10 is a similar view to FIG. 8 in which the cover occupies a second position in which it is partially screwed.

FIG. 11 is a similar view to FIG. 8 in which the cover is in a fully screwed position on the base.

DETAILED DESCRIPTION OF THE INVENTION

In the following description, elements with identical structure or similar functions will be referred to by the same reference.

In the remainder of the description, an axial orientation parallel to a main axis of the case, and indicated by the arrow "A" which is directed from bottom to top, will be adopted. Radial orientations extending radially with respect to the main axis of the case from the inside to the outside will also be adopted. Tangential orientations that are orthogonal to the axial and radial orientations will also be adopted.

In the embodiments of the case shown in the figures, said main axis constitutes an axis of rotation for screwing the cover onto a base of the case.

The terms "top" and "bottom", "above" and "below", "upper" and "lower" are used as geometric reference frame in relation to the axial orientation as shown in the figures and independently of the direction of the gravity of the earth.

FIG. 1 shows a case 10 for a powder cosmetic product in closed position, and FIG. 2 shows the same case 10 in open position.

A powder cosmetic product is for example loose powder to be used for make-up. For example, it is a powder cosmetic product applied to the face with an applicator (not shown), in particular by means of a brush or a sponge (or any other equivalent means).

Preferably, the powder cosmetic product is intended to be applied by means of a brush which is here separate from said case 10.

The case 10 of powder cosmetic product comprises at least one cover 12 and a base 14 that are movably mounted relative to each other between at least one closed position, shown in FIG. 1, and an open position of the case 10, shown in FIG. 2, in which the cover 12 is removed from the base 14.

The cover 12 is intended to be screwed onto an associated thread 34 of the base 14. The case 10 has a main axis O determining the axial direction. The base 14 is located at the bottom and the cover 12 at the top. The cover 12 is more particularly intended to be screwed by rotation about the main axis O on the base 14.

The cover 12 and the base 14 have a complementary shape that gives the case 10 its aesthetic appearance, in particular in closed position.

In a non-limiting way, the case 10 has a general cylindrical shape of revolution centred on said main axis O.

Alternatively, the case could have another general shape, in particular a parallelepiped shape, in particular a square or rectangular shape.

Advantageously, the case 10 is a "compact" type case, i.e. sized so that it can be conveyed, in particular but not exclusively in a bag, for example a handbag of a user.

Preferably, the cover 12 is removable from the base 14, i.e., the cover 12 is separate from the base 14 in the open position of the case 10 as shown in FIG. 2.

Alternatively, the cover could be connected to the base by means of a flexible attachment allowing it to be screwed and unscrewed from the base.

The base 14 comprises a cavity 16 for receiving said product, visible for example in FIG. 8. The cavity 16 opens axially upwards through an opening 18 into an axially upwardly open bowl 20 outside the base.

A sifter 22 equipped with passage orifices of the product is arranged in the opening 18 to form a delimitation between the cavity 16 and the bowl 20.

Thus, the invention is applicable to a case 10 comprising mainly the cavity 16 for receiving the cosmetic product delimited upwardly by the sifter 22 and which opens into a bowl 20.

As shown in more detail in FIG. 3, in the example embodiment shown in the figures, the base 14 comprises, in a non-limiting way, several components assembled.

Here, the base 14 comprises a pedestal 24, a container 26 and a ring 28 for attaching the container 26 in the pedestal 24. This configuration allows the container 26 to be replaced when it is empty or when a cosmetic product is desired to be changed in a clean and quick manner, while retaining the rest of the case 10. This configuration is therefore both economical and ecological.

For this purpose, the pedestal 24 comprises a housing 29. The housing 29 is divided into two portions. A lower portion 30 of the housing 29 is intended to receive the container 26, while the upper portion of the housing 29 is intended to remain free to receive the bowl 20 allowing to collect powder cosmetic product present on the sifter 22 by means of an applicator without risk of spilling it everywhere.

The upper portion of the housing 29 is radially delimited by a cylindrical wall 32. The cylindrical wall 32 comprises on its external face the thread 34 for screwing the cover 12. The cylindrical wall 32 comprises a free upper end edge 35.

The upper portion of the housing 29 is delimited from the lower portion 30 by a face 36 with an annular bearing surface which is turned axially upwards.

The container 26 here comprises the cavity 16 which is delimited radially by a peripheral wall 38 and axially downward by a bottom 40, visible for example in FIG. 8. The sifter 22 is intended to be attached to an upper end edge 42 of the peripheral wall 38.

In the embodiment shown in the figures, at least one of the peripheral wall 38 and the bottom 40 is made of a material sufficiently flexible that a user can lift the bottom 40 to bring it into contact with the sifter 22 by simply pressing on the bottom 40 with a finger of the hand. For this purpose, the housing 29 of the pedestal 24 is closed downwards by a bottom 41 which is perforated with a window 43 for access to the bottom 40 of the container 26.

Such an arrangement thus allows the cosmetic product to be passed over the sifter 22 by lifting the bottom 40, without having to tip the container 26 to drop the cosmetic product.

The sifter 22 is a flexible sifter which is made, for example, in the form of a grid, of nylon or other material, consisting of a set of meshes each delimiting one of the orifices for the passage of the powder cosmetic product out of the cavity.

To allow to keep the sifter 22 stretched across the opening 18, the sifter 22 is carried by a frame 44 of complementary shape to that of the outline of the opening 18, here of circular shape, centred on the main axis O. The frame 44 is made of a much more rigid material than the peripheral wall 38 and/or the bottom 40 of the container 26.

The frame 44 is for example made of a plastic material over-moulded on the periphery of the sifter 22.

The frame 44 is mounted by snap fitting on the upper edge 42 of the container 26. Thus, the container 26 and the sifter 22 are attached to each other to form a single component that is easy to house in the pedestal 24 and replace. The frame 44 allows the upper end of the peripheral wall 38 to be made more rigid. The container 26 thus maintains an opening 18 of same shape, in this case circular, at all times during the use of the housing 10.

The container 26 further comprises a rim 46 that surrounds the opening 18. The rim 46 projects radially outwardly from the peripheral wall 38. When the container 26 is positioned in its housing 29, it rests by means of its rim 46 which rests on the bearing face 36 of the pedestal 24, as shown in FIG. 8.

Since the container 26 is very flexible, it would be complicated to extract it from the top of the housing 29 by exerting a pressure through the window 43 without spilling the remaining powder it contains to the outside. It is therefore preferable to be able to grip it by a more rigid portion, namely by the rim 46, made more rigid by the frame 44. To allow the container 26 to be easily grasped by the frame 44 and/or the rim 46, the cylindrical wall 32 of the pedestal 24 comprises at least two radially opposed indentations 48 that provide access to at least the rim 46 of the container 26. The indentations 48 are made in the upper edge 35 of the cylindrical wall 32. They extend downwards up to the face 36 of the bearing surface. Each indentation 48 allows a user to grasp the rim 46 with the pad of two fingers.

The ring 28 for attaching the container 26 is attached by dismountable attachment means in the housing 29 by tightening the rim 46 of the container 26 against the bearing face 36. The ring 28 will thus hold the container 26 firmly in its housing 29.

The attachment ring 28 comprises a peripheral wall 50 which has an external diameter slightly smaller than the internal diameter of the cylindrical wall 32 of the pedestal 24 so that the ring 28 is received in the upper portion of the housing 29 with a radial clearance allowing the mounting and the dismounting.

The attachment ring 28 also comprises an annular upper wall 52 inclined in the direction of the opening 18 of the container 26 that radially delimits the bowl 20. The upper wall 52 thus forms a funnel that allows the cosmetic product to slide towards the sifter 22. For this purpose, the upper wall 52 has an inner diameter that is approximately equal to the diameter of the sifter 22.

As illustrated in FIG. 8, the upper wall 52 has a lower annular face 54 that is intended to press against the rim 46 of the container 26 when the attachment ring 28 is mounted in the pedestal 24. Here, the annular face 54 presses against the rim 26 by means of the frame 44 of the sifter 22. Thus, the attachment ring 28 holds the container 26 firmly in position in its housing 29. The rim 46 is tightened axially between the attachment ring 28 and the bearing face 36.

The attachment ring 28 is mounted in a sealing manner around the container 26. To this end, the frame 44 has a flexible lip 56 that extends radially outward from the circumference of the frame 44. An annular bead 57 on the upper wall 52 of the attachment ring 28 is intended to come into tight axial contact with the lip 54 to ensure a good sealing preventing the cosmetic product from passing between the container 26 and the attachment ring 28.

The attachment ring 28 is attached to the pedestal 24 by snap fitting in an axial direction. For this purpose, the attachment ring 28 comprises two axially extending attachment tabs 58 which are elastically deformable in flexion. Each attachment tab 58 is equipped at its free lower end with a crampon 60 which is intended to be fitted, here radially outwards, into a notch 62 of the pedestal 24. Thus, each attachment tab 58 is flexible between a fitting state of the crampon 60 in its notch 62, towards which it is elastically biased, and a disengaged state, in which it is flexed radially inward and is stressed against the elastic biasing force.

An upper portion of the attachment tabs 58, ensuring the connection with the rest of the ring 28, is formed by a portion of the peripheral wall 50 delimited, along the circumference of the ring 28, by two axial slits 64 which are made in the peripheral wall 50 and which open downwards. These two slits 64 thus promote the flexibility of each attachment tab 58.

The attachment tabs 58 are here two in number and they are arranged diametrically opposite to the main axis O of the case 10.

The notches 62 are here arranged in line with the indentations 48. The notches 62 are more particularly arranged below the bearing face 36. This arrangement allows a user to bias the attachment tabs 58 towards their constrained state by biasing them directly with their fingers through the indentations 48. Thus, the attachment ring 28 can be easily removed.

To allow the attachment ring 28 to be properly positioned relative to the pedestal 24, the upper portion of each attachment tab 58, formed in the peripheral wall 50, comprises a radially outwardly extending projection 66 that is axially nested with the indentation 48. These projections 66 come in abutment against the upper edge 35 of the cylindrical wall 32 of the pedestal 24 when they are not aligned with an indentation 48.

The projections 66 also allow the ring 28 to be immobilized in rotation about the main axis O with respect to the pedestal 24.

The cover 12 for closing the housing 29 is intended to be screwed onto the thread 34 of the pedestal 24 between a fully unscrewed position, as shown in FIG. 8, and a fully screwed position, as shown in FIG. 11, in which it is brought axially closer to the sifter 22 to allow the cavity 16 to be sealed. The screwing is done by rotating the cover 12 around the main axis O of the case 10.

As shown in FIGS. 4 and 5, the cover 12 comprises an upper wall 68 from which a cylindrical wall 70 extends downward. An internal face of the cylindrical wall 70 comprises a thread 71 complementary to that of the pedestal 24 so that the cover 12 can be screwed to the pedestal 24.

The cover 12 is equipped with a seal 72 which is intended to seal the opening 18 in the fully screwed position of the cover to prevent the cosmetic product from exiting its cavity 16.

As shown in FIGS. 4 to 7, the seal 72 comprises a sealed membrane 74 that extends generally parallel to the sifter 22. The membrane 74 comprises a lower face which forms a contact face 76 intended to rest on the entire surface of the sifter 22 when the cover 12 is in its fully screwed position. The membrane 74 has a circular outline with a diameter at least equal to that of the sifter 22.

The contact face 76 is made of a material that has substantially no porosity capable of retaining or storing grains of cosmetic products. In particular, the contact face 76 does not have the structure of a sponge. The seal 72 is made of an elastomeric material. Here, the seal 72 is made in one part, for example by moulding.

When the seal 72 is attached to the cover 12, the membrane 74 is arranged away from the upper wall 50 so that a chamber 78 is axially delimited between the cover 12 and the membrane 74. The chamber 78 extends over substantially the entire surface of the sifter 22.

The membrane 74 is made of a flexible material. This chamber 78 allows the membrane to deform in flexion under the effect of a pressure applied upwardly on the contact face 76. The contact face has, at rest, a different shape than that of the sifter 22. The membrane 74 is thus elastically deformable in flexion so that the contact face 76 conforms to the shape of the sifter 22 during the screwing of the cover 12 as will be explained in more detail later.

The seal 72 comprises a section 80 that is elastically deformable in an axial direction and is attached to the interior of the cover 12 by an upper end. The membrane 74 is attached to a lower end of the deformable section. The elastically deformable section 80 radially delimits the chamber 78. The membrane 74 is thus secured in rotation with the cover 12 around the main axis O.

The deformable section 80 is here formed by an annular bellow that surrounds the chamber 78. An upper edge 82 of the bellow forming the deformable section 80 is intended to axially abut against a lower face of the upper wall 68 of the cover 12.

To allow the seal 72 to be attached to the cover 12, the upper edge 82 of the deformable section 80 has radially outwardly projecting teeth 84. These teeth 84 are intended to be radially embedded in notches 86 made in a circular partition 88 that extends axially downward from the lower face of the upper wall 68 of the cover 12. The circular partition 88 is here adapted to internally receive the upper edge 82 of the deformable section 80, with or without clearance. The deformable section 80 is made of sufficiently flexible material to allow the teeth 84 to snap fit into the notches 86.

During the screwing and the unscrewing of the cover 12, the volume of the chamber 78 is intended to vary as a function of the deformations of the deformable section 80, on the one hand, and the deformations in flexion of the membrane 74, on the other hand. To allow the air to enter and exit the chamber 78 to promote these deformations, at least one vent 90 of air passage is provided between the chamber 78 and the exterior of the seal 72. The vents 90 are here made in the form of grooves made in the upper edge 82 of the deformable section 80. The vents 90 are arranged in correspondence with reserved passages 92 in the circular partition 88.

As will be explained later, the contact face 76 is intended to rub against the sifter 22 during the rotation of the cover 12. This rubbing allows to push the grains of cosmetic product through the orifices in the sifter 22 back into the cavity 16. Thus, the sifter 22 and the contact face 76 are cleaned and do not comprise cosmetic product when the cover 12 is opened again.

In order to achieve this rubbing effect, the contact face 76 comprises relief elements. The relief elements form a multitude of roughnesses on the contact face 76. More particularly, these relief elements are formed here by a multitude of pimples 94, visible in more detail in FIG. 4.

The pimples 94 are evenly distributed over the entire contact face 76. In a variant of the invention not shown, the pimples are distributed with a greater density in the centre of the contact face 76 than at its periphery.

Here, the pimples 94 protrude axially by a height much less than the thickness of the membrane 74, for example by a tenth of millimetre.

The pimples 94 are all the same height.

Alternatively, the pimples can have different heights depending on their location.

Moreover, the pimples have dimensions much smaller than the diameter of the contact face, for example in the order of millimetre or even tenth of millimetre. The pimples 94 are distributed with a high density. For example, the space between the summit of two adjacent pimples 94 is between one and two times the width of the base of a pimples 94.

Preferably, but not necessarily, the compressive flexibility of the membrane 74 is much less than its flexural flexibility. Similarly, the compressive flexibility of the membrane 74 is much less than the axial deformation flexibility of the deformable section 80. This means that when the membrane 74 is pressed against the sifter 22, the pimples 94 are not deformed by crushing. The pimples 94 thus remain in relief even when the membrane 74 is pressed against the sifter 22. When the cover 12 is pressed downwards, it is the deformation in flexion of the membrane 74 and the axial deformation of the deformable section 80 that absorb these forces.

This allows to ensure an optimal cleaning of the sifter 22 while avoiding creating a suction of the cosmetic product when removing the membrane 74, as will be explained in more detail later.

In addition, the membrane 74 comprises an annular sealing segment 96 at its periphery that surrounds the contact face 76.

This annular sealing segment 96 is here formed by two superimposed and parallel annular beads that project radially outward from a peripheral edge of the membrane 74. The sealing segment 96 is intended to come into sealed contact with an annular face 98 of the base 14 in fully screwed position of the cover 12.

As shown in FIG. 11, when pressed against the sifter 22, the membrane 74 has an outer diameter that is substantially equal to the inner diameter of the upper wall 52 of the attachment ring 28. More particularly, the diameter of the membrane 74 is selected so that the sealing segment 96 is in radial abutment outwardly against the internal edge of the upper wall 52, which thus forms the annular face 98, when the contact face 76 is pressed against the sifter 22.

As is particularly apparent in FIGS. 8 and 9, the contact face 76 of the membrane 74 has, at rest, a convexly shaped periphery so that the sealing segment 96 is arranged axially above the level of the remainder of the contact face 76.

More particularly, the contact face 76 here has a convex shape over its entire surface from a central point arranged substantially at the level of the main axis O of the case 12.

Because of this convex shape, the membrane 74 is elastically deformable when the cover 12 is screwed on between a state of partial contact with the sifter 22 when the cover 12 occupies a first position, as shown in FIG. 9, and a state of total axial abutment against the entire surface of the sifter when the cover occupies a second position, as shown in FIG. 10.

The second partial screwed position is between the first position and the fully screwed position of the cover 12. Thus, the contact face 76 is in contact with the entire sifter 22 before the cover 12 is completely screwed on. Thus, as the cover 12 continues to be rotated to complete the closing operation by screwing, the membrane 74 is driven in rotation by the cover 12. This provides an effective cleaning of the entire surface of the sifter 22 and the contact face 76 of the membrane 74.

To promote a proper cleaning of the sifter 22 and of the membrane 74, the deformable section 80 has a lower flexibility than the flexibility in flexion of the membrane 74 so that the contact face 76 begins to deform before the deformable section 80. Therefore, when the cover is screwed on, the membrane 74 will first reach its full contact state, and then the deformation of the deformable section 80 will absorb the axial displacements of the cover 12.

The first position is preferably intermediate between the fully unscrewed position and the second position. This means that in its fully unscrewed position, i.e., when the cover 12 is placed on the base 14 without that the screwing having begun, as shown in FIG. 8, the contact face 76 of the membrane 74 is located at a distance above the sifter 22. This allows, for example, a user to use the case 10 by discharging cosmetic product onto the sifter 22, and then placing the cover 12 on the base 14, for example, to prevent an air stream from carrying away the cosmetic product, without the cosmetic product gluing to the membrane 74.

To facilitate the recycling of the case 10, the seal 72 and the cover are made of one or more materials that can be treated by the same recycling stream. The cover and the seal 72 are made of polypropylene (PP), for example.

The operation of the invention is now described with reference to FIGS. 8 to 11.

As shown in FIG. 8, the cover 12 is first placed on the base 14 without being screwed on. In this fully unscrewed position, the membrane 74 of the seal 72 is arranged at a distance above the sifter 22. The deformable section 80 and the membrane 74 are in a resting state.

Then, the cover 12 begins to be screwed on by rotation about the main axis O with respect to the base 14. By cooperation between the threads 34 and 71, the cover 12 moves axially in the direction of the base 14 until it reaches the first position in which the membrane 74 comes into contact with the sifter 22, as shown in FIG. 9. In this first position, and due to its convex shape, the contact face 76 is in contact with the sifter 22 through a central point 100 located along the main axis O. In this first position, the sealing segment 96 of the membrane 74 is not yet in sealed contact with the annular face 98 of the base 14. Thus, the air is still able to pass between the cavity 16 and the outside.

As the cover 12 continues to be screwed on, and due to the greater flexibility in flexion of the membrane 74, the latter deforms in flexion as it abuts against the sifter 22. Due to this deformation in flexion of the membrane 74, the contact surface area between the contact face 76 and the sifter 22 gradually increases. The contact surface area here has a disc shape, the diameter of which increases as the cover 12 moves closer to the sifter 22. Thus, an annular area of the sifter 22, which surrounds the contact surface area, remains free. Air is therefore still likely to flow between the inside and the outside of the cavity 16 through this free annular area. The volume of the chamber 78 decreases as the membrane 74 deforms in flexion.

During the screwing, the cover 12 reaches its second position, as shown in FIG. 10. The contact face 76 then reaches its fully axially supported state before the cover 12 reaches its fully screwed position. In this position, the sealing segment 96 is then in sealed contact with the annular face 98 of the base 14. The cavity 16 is thus sealed by the membrane 74. The contact face 76 is then pressed axially against the entire surface of the sifter 22. The deformable section 80 is only slightly, if at all, axially deformed.

As the cover 12 continues to be screwed on, the contact face 76 rotates, rubbing against the entire surface of the sifter 22. This forces the cosmetic product grains back into the cavity 16 through the sifter 22. Thus, the surface of the sifter 22 and the contact face 76 are simultaneously cleaned of cosmetic product residue. The cover 12 is thus rotated about its main axis O until it reaches its fully screwed position on the base 14, as shown in FIG. 11. Between the second position, shown in FIG. 10, and the fully screwed position, shown in FIG. 11, the cover 12 can be rotated, for example, through an angle of rotation of between a quarter turn and two turns. Of course, the greater the angle of rotation, the more effective the cleaning.

Between its second position and its fully screwed position, the cover 12 moves even closer to the sifter 22. To prevent the membrane 74 from pressing too hard against the sifter 22, which could damage the latter, the deformation of the deformable section 80 allows the cover 12 to slide axially towards the sifter 22 up to its fully screwed position without the pressure of the contact face 76 against the sifter 22 being substantially augmented. The volume of the chamber 78 then becomes minimal, but not zero, with the membrane 74 still spaced from the upper wall 68 of the cover 12 in this fully screwed position.

The fully screwed position is stopped, for example, when a lug 102 carried by one of the cover 12 or the pedestal 24 is snap fitted into a notch 104 carried by the other of the cover 12 or the pedestal 24. The lug 102 is here made in relief at the bottom of the internal face of the cylindrical wall 70 of the cover 12, below the thread 71 as shown in FIG. 4. The notch 104 is here made at the bottom of the external face of the cylindrical wall of the pedestal, below the thread 34, as shown in FIG. 3.

The case 10 is then sealed.

When the case 10 is opened again, the cover 12 is rotated in an unscrewing direction about the main axis O relative to the base 14. The seal 71 is configured so that, upon unscrewing, the periphery of the contact face 76 begins to move axially away from the sifter 22 to release a peripheral area of the sifter 22. A complementary inner area of the sifter 22 of said peripheral area remains in full contact with the contact face 76.

The sealing segment 96 is moved away from its bearing face prior to or simultaneously with the initiation of the movement away from the periphery of the contact face 76 of the peripheral area of the sifter 22 to create an interstice for air to pass into the interior of the cavity 16 through said peripheral area.

This avoids a suction-cup effect that would oppose the opening of the cover 12. This also prevents the suction of cosmetic product over the sifter 22 that could occur if the contact face had the same shape as the sifter 22.

On the contrary, the fact that the contact face 76 progressively moves away from the sifter 22, regaining its convex shape as the cover 12 is unscrewed, allows the surface of the sifter 22 to be progressively released from the outside inwards, thus avoiding the air streams above the sifter 22.

Thus, when the user opens the case 10 again, not only the sifter 22 but also the contact face 76 of the seal 72 is cleaned. This allows to avoid spilling cosmetic product everywhere. In order to use the cosmetic product, the user must therefore voluntarily move the bottom 40 of the container 26 upwards by finger pressure to make the desired amount of cosmetic product pass over the sifter 22.

The invention claimed is:

1. A case for powder cosmetic product comprising:

a base comprising a cavity for receiving said product, the cavity opening out axially through an opening;

a sifter arranged in the opening;

a closing cover configured to be screwed onto the base between a fully unscrewed position and a fully screwed position in which it is axially brought closer to the opening to allow its sealed closure; and a seal attached to the cover by an upper end which comprises:

a lateral section elastically deformable in an axial direction;

a membrane which is attached to a lower end of the deformable section and which comprises a contact face intended to rest on an entire surface of the sifter; and a chamber delimited between the cover and the membrane, wherein the contact face of the membrane is elastically deformable in flexion so that the contact face conforms to a shape of the sifter when the cover is screwed on, the contact face having relief elements, wherein the relief elements include protruding elements having complementary arrangement with sifter openings of the sifter such that the protruding elements rub against the sifter during rotation of the cover.

2. The case according to claim 1, wherein the contact face has a different shape between the fully unscrewed position of the cover and the fully screwed position of the cover.

3. The case according to claim 2, wherein the membrane is elastically deformable in flexion when the cover is screwed on between a state of partial contact of the contact face with the sifter when the cover occupies a first position and a state of total axial abutment of the contact face against the entire surface of the sifter when the cover occupies a second position.

4. The case according to claim 3, wherein, during screwing on, the contact face reaches its state of total axial abutment before the cover reaches its fully screwed position, the deformation of the deformable section allowing an axial sliding of the cover towards the sifter up to its fully screwed position.

5. The case according to claim 1, wherein an annular sealing segment of the membrane, which surrounds the contact face, is configured to come into sealed contact with an annular face of the base in fully screwed position.

6. The case according to claim 5, wherein the seal is configured so that, upon unscrewing, a periphery of the contact face begins to move axially away from the sifter to release a peripheral area of the sifter, a complementary inner area of said peripheral area remaining entirely in contact with the contact face.

7. The case according to claim 6, wherein the seal is configured so that the sealing segment is moved away from its bearing face prior to or simultaneously with initiation of movement away from the periphery of the contact face of the peripheral area of the sifter to create an interstice for passage of air into the cavity through said peripheral area.

8. The case according to claim 1, wherein the contact face of the seal has, in a resting state of the membrane, a periphery of convex shape.

9. The case according to claim 8, wherein, in a resting state of the membrane, the contact face has a convex shape over its entire surface from a central point arranged substantially at a level of a central axis of the sifter.

10. The case according to claim 1, wherein the elastically deformable section is formed by an annular bellow which surrounds the chamber.

11. The case according to claim 10, wherein the deformable section has a lower flexibility than that of the membrane so that the contact face begins to deform in flexion before an attachment section.

12. The case according to claim 1, wherein the seal is made in one part.

13. The case according to claim 1, wherein the seal and the cover are made of the same material.

14. The case according to claim 1, wherein the relief elements are evenly distributed over the entire surface of the contact face.

15. The case according to claim 1, wherein the relief elements are pimples.

* * * * *